US010220976B2

(12) United States Patent
Zacherle

(10) Patent No.: US 10,220,976 B2
(45) Date of Patent: Mar. 5, 2019

(54) ENCLOSED TOP STACKS

(71) Applicant: WestRock Packaging Systems, LLC, Norcross, GA (US)

(72) Inventor: Matthew E. Zacherle, Chesterfield, VA (US)

(73) Assignee: WestRock Packaging Systems, LLC, Atlanta, GA (US)

( * ) Notice: Subject to any disclaimer, the term of this patent is extended or adjusted under 35 U.S.C. 154(b) by 0 days.

(21) Appl. No.: 15/569,117

(22) PCT Filed: Apr. 26, 2016

(86) PCT No.: PCT/US2016/029298

§ 371 (c)(1),
(2) Date: Oct. 25, 2017

(87) PCT Pub. No.: WO2016/178853

PCT Pub. Date: Nov. 10, 2016

(65) Prior Publication Data

US 2018/0111714 A1 Apr. 26, 2018

Related U.S. Application Data

(60) Provisional application No. 62/155,540, filed on May 1, 2015.

(51) Int. Cl.
*B65D 5/54* (2006.01)
*B65D 71/36* (2006.01)
(Continued)

(52) U.S. Cl.
CPC ..... *B65D 5/5445* (2013.01); *B65D 5/0227* (2013.01); *B65D 5/4266* (2013.01);
(Continued)

(58) Field of Classification Search
CPC .... B65D 5/5445; B65D 71/36; B65D 5/0227; B65D 5/4608; B65D 2571/0066;
(Continued)

(56) References Cited

U.S. PATENT DOCUMENTS 5,246,113 A * 9/1993 Schuster ..... B65D 5/46088 206/160
5,368,194 A * 11/1994 Oliff ..... B65D 71/36 206/427

(Continued)

FOREIGN PATENT DOCUMENTS

WO WO2005051781 A1 6/2005

*Primary Examiner* — Christopher Demeree
(74) *Attorney, Agent, or Firm* — WestRock Intellectual Property Group

(57) ABSTRACT

A carton includes an outer shell (102) defining an interior space with upper and lower tiers. A divider (120) is disposed at least in part in the outer shell dividing between the upper and lower tiers. A tear strip (118) defined in the outer shell operatively connecting an upper portion of the outer shell to a lower portion thereof. The upper portion defines a six-sided structure, a bottom side of which includes the divider. The upper portion is configured to be removed from the lower portion by lifting the upper portion after the tear strip is activated.

20 Claims, 12 Drawing Sheets

(51) Int. Cl.
*B65D 5/02* (2006.01)
*B65D 5/468* (2006.01)
*B65D 5/42* (2006.01)
*B65D 71/38* (2006.01)

(52) U.S. Cl.
CPC ..... *B65D 5/4608* (2013.01); *B65D 71/36* (2013.01); *B65D 71/38* (2013.01); *B65D 2571/0045* (2013.01); *B65D 2571/0066* (2013.01); *B65D 2571/00141* (2013.01); *B65D 2571/00401* (2013.01); *B65D 2571/00469* (2013.01); *B65D 2571/00567* (2013.01); *B65D 2571/00728* (2013.01)

(58) Field of Classification Search
CPC .. B65D 2571/00401; B65D 2571/0045; B65D 2571/00567; B65D 5/4266; B65D 2571/00141; B65D 2571/00728; B65B 35/50
USPC ..... 229/117.09, 120.011, 120.32, 200, 242; 206/821, 193, 192, 199, 736; 53/157, 53/447, 48.1; 221/305
See application file for complete search history.

(56) References Cited

U.S. PATENT DOCUMENTS 5,427,242 A * 6/1995 Oliff ..... B65D 71/36 206/160
5,437,143 A * 8/1995 Culpepper ..... B65B 5/106 53/156
5,505,372 A * 4/1996 Edson ..... B65D 71/36 229/121
5,518,111 A * 5/1996 Stout ..... B65D 71/36 206/160
5,669,500 A * 9/1997 Sutherland ..... B65D 5/0227 206/427
5,682,984 A * 11/1997 Hoell ..... B65D 71/36 206/161
5,687,847 A * 11/1997 Culpepper ..... B65D 71/246 206/199
5,772,030 A * 6/1998 Baxter ..... B65D 71/36 206/427
5,853,088 A * 12/1998 Saulas ..... B65D 71/36 206/427
6,918,487 B2 * 7/2005 Harrelson ..... B65D 5/725 206/427
7,073,705 B2 7/2006 Auclair et al.
7,717,321 B2 * 5/2010 Spivey, Sr. ..... B65D 71/36 206/192
8,459,535 B2 * 6/2013 Brand ..... B65D 71/36 206/736
2005/0115843 A1 * 6/2005 Harrelson ..... B65D 71/36 206/170
2005/0167290 A1 * 8/2005 Sutherland ..... B65D 71/36 206/170
2005/0167292 A1 * 8/2005 Sutherland ..... B65D 71/36 206/170
2013/0256392 A1 10/2013 Kohler

* cited by examiner

ENCLOSED TOP STACKS

BACKGROUND OF THE INVENTION

1. Field of the Invention

The present disclosure relates to packaging, and more particularly to cartons for packaging upper and lower tiers of articles.

2. Description of Related Art

One way to package articles such as beverage cans is to place the cans into a paperboard carton in which the cans are arranged in two tiers. An example of this can be seen in U.S. Pat. No. 5,437,143 wherein two tiers of six cans are shown being placed into a carton to form a twelve-pack.

In cartons of this type, to avoid unwanted can-to-can contact between the tiers, it is common for a paperboard divider panel to be used to separate the tiers. The common practice, shown generally in the above-referenced U.S. Pat. No. 5,437,143, which is incorporated herein by reference in its entirety, is to first form the cans which will occupy the lower tier into a shaped group outside of the carton. After this group is formed, the paperboard divider is placed onto the top of the cans of the lower group. A process directs cans which will occupy the upper tier onto the panel and arranges the cans into the upper group. The completed assembly is then loaded into the carton through an open end. The procedure uses specialized machinery to carry out the necessary operations.

Such conventional methods and systems have generally been considered satisfactory for their intended purpose. However, there is still a need in the art for improved cartons and containers. The present disclosure provides a solution for this need.

SUMMARY OF THE INVENTION

A carton includes an outer shell defining an interior space with upper and lower tiers. A divider is disposed at least in part in the outer shell to divide between the upper and lower tiers. A tear strip defined in the outer shell operatively connecting an upper portion of the outer shell to a lower portion thereof. The upper portion defines a six-sided structure, a bottom side of which includes the divider, the upper portion including a handle wherein the upper portion is configured to be removed from the lower portion by lifting the upper portion by the handle after the tear strip is activated. Opposed side end flaps of the outer shell are disposed between a bottom end flap of the divider and a pair of opposed side end flaps of the divider.

The end flaps of the outer shell can be adhered to outer surfaces of the pair of opposed side end flaps of the divider, wherein the bottom end flap of the divider is adhered to outside surfaces of the side end flaps of the outer shell. It is contemplated that the bottom end flap of the divider can be not adhered directly to the side end flaps of the divider. It is also contemplated that the bottom end flap of the divider can be adhered directly to the side end flaps of the divider. For example, the bottom end flap of the divider can be adhered directly to the side end flaps of the divider through a respective window defined through each respective side end flap of the outer shell.

The side end flaps of the outer shell, the side end flaps of the divider, the bottom end flap of the divider, and a top end flap of the outer shell can all be adhered together along a single line of adhesive. The line of adhesive can join the top end flap to the side end flaps of the divider through a respective window defined through each side end flap of the outer shell. The line of adhesive can join an inner surface of the top end flap to an outer surface of the bottom end flap of the divider. The line of adhesive can join an inner surface of the top end flap to an outer surface of each side end flap of the outer shell.

The tear strip can be below where the divider is attached to the outer shell so activation of the tear strip allows removal of the upper portion of the outer shell such that the upper portion can be removed as a separate six-sided container leaving the lower portion with an open top. The divider can include a handle portion operatively connected to the handle of the outer shell for handle reinforcement.

A method of forming a carton includes providing an outer shell defining an interior space with upper and lower tiers. The method also includes securing a divider to the outer shell to divide between the upper and lower tiers, wherein a tear strip operatively connects between an upper portion and a lower portion of the outer shell, the upper portion including a handle wherein the upper portion is configured to be removed from the lower portion by lifting the upper portion by the handle after the tear strip is activated. The securing step includes adhering side end flaps of the outer shell between a bottom end flap of the divider and a pair of opposed side end flaps of the divider.

These and other features of the systems and methods of the subject disclosure will become more readily apparent to those skilled in the art from the following detailed description of the preferred embodiments taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, preferred embodiments thereof will be described in detail herein below with reference to certain figures, wherein.

DETAILED DESCRIPTION OF THE PREFERRED EMBODIMENTS

Figure 1:
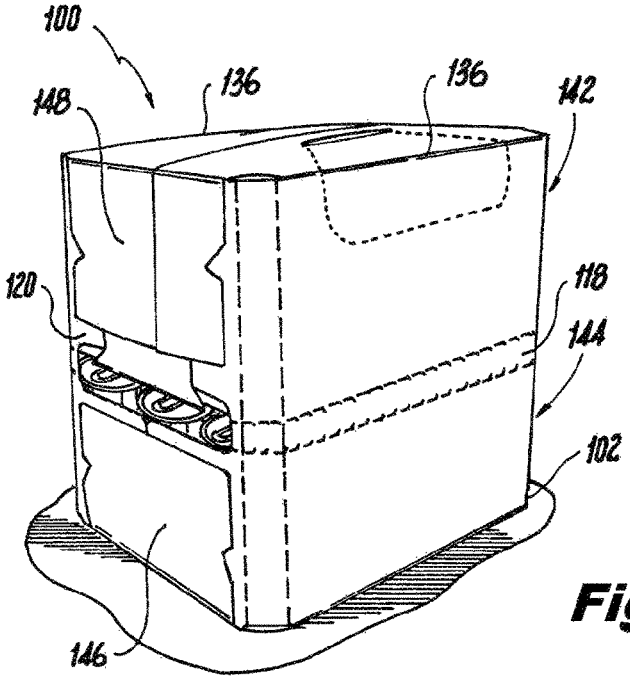
FIG. 1 is a perspective view of an exemplary embodiment of a carton constructed in accordance with the present disclosure, showing the upper and lower tiers connected by tear strips.

Reference will now be made to the drawings wherein like reference numerals identify similar structural features or aspects of the subject disclosure. For purposes of explanation and illustration, and not limitation, a partial view of an exemplary embodiment of a carton in accordance with the disclosure is shown in FIG. 1 and is designated generally by reference character 100. Other embodiments of cartons in accordance with the disclosure, or aspects thereof, are provided in FIGS. 2-18, as will be described. The systems and methods described herein can be used for packaging items such as canned goods or beverages.

Figure 2:
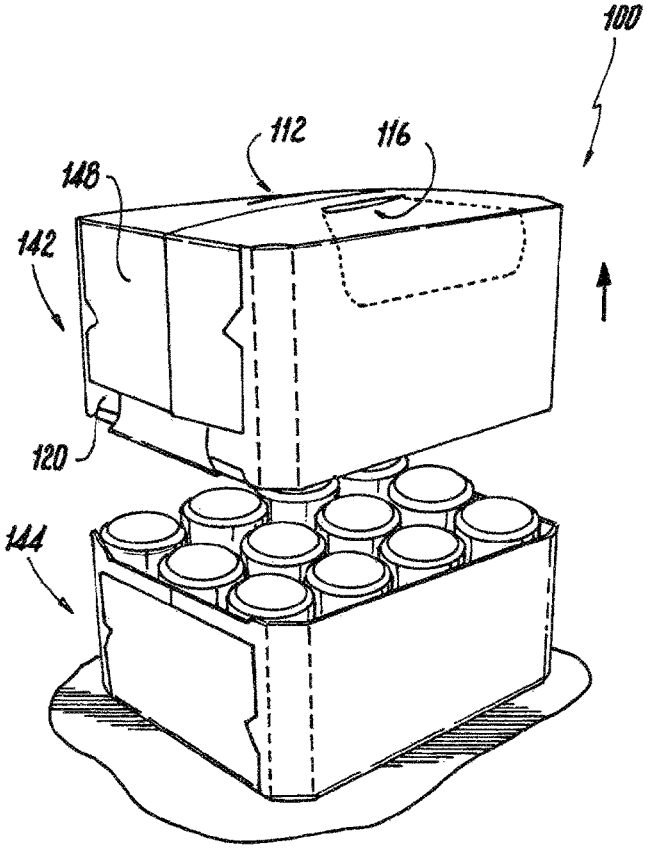
FIG. 2 is a perspective view of the carton of FIG. 1, showing the tear strips removed and the upper and lower tiers separated from one another.

Carton 100 includes an outer shell 102 defining an interior space with upper and lower tiers 142 and 144. Divider 120 is hingedly connected to the outer shell by fold lines 125 (identified in FIG. 4), and divides between the upper and lower tiers 142 and 144 before tear strip portions 118 are activated. The tear strip connects the upper portion of the outer shell 102 to the lower portion thereof until tear strip portions 118 are activated or removed, as they are shown in FIG. 2. With the tear strip removed, the upper portion of carton 100 defines a six-sided structure, a bottom side of which includes divider 120, the upper portion including a handle formed of handle portions 112 and 116. The upper portion is configured to be removed from the lower portion by lifting the upper portion using the handle after the tear strip is activated. As oriented in FIGS. 1 and 2, the tear strip is below where divider 120 is attached to the outer shell so activation of the tear strip allows removal of the upper portion of the outer shell as a separate six-sided container, leaving the lower portion with an open top. So, for example, the lower, open portion can be immediately placed in a refrigerator, and the upper portion can be stored elsewhere as a separate container until the contents of the lower portion have been consumed.

Figure 3:
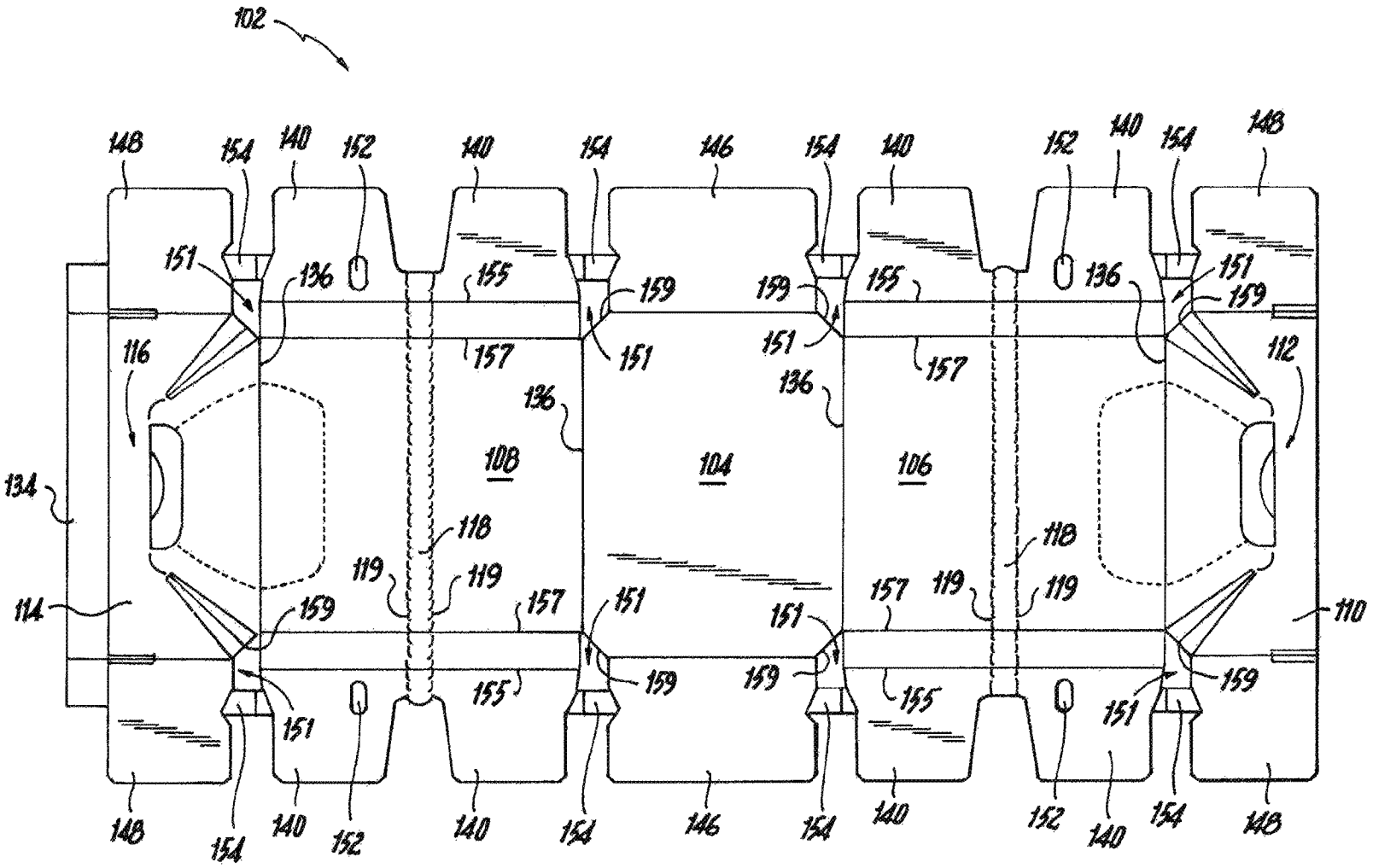
FIG. 3 is a plan view of a blank for the outer shell of the carton of FIG. 1.

With reference first to FIG. 3, a combination of material blanks for forming a carton 100 is described. The combination includes an outer shell blank 102, shown in FIG. 3, and a divider blank 120, shown in FIG. 4. Each of blanks 102 and 120 is formed from a sheet of suitable substrate. It is to be understood that, as used herein, the term "suitable substrate" includes all manner of foldable sheet material such as paperboard, corrugated board, cardboard, plastic, combinations thereof, and the like. Outer shell blank 102 has a base panel 104. A first sidewall panel 106 is connected to a first side of base panel 104. A second sidewall panel 108 is connected to a second side of base panel 104 opposite the first side. A first top panel 110 is connected to a side of first sidewall panel 106 opposite base panel 104, with a first handle portion 112 defined in first top panel 110. A second top panel 114 is connected to a side of second sidewall panel 108 opposite base panel 104, with a second handle portion 116 defined in second top panel 114. Each of the first and second sidewall panels 106 and 108 includes a portion of a tear strip 118 which is defined by a pair of coextending severance lines, such as parallel perforations 119. The panels of the sidewalls 106 and 108 include respective sidewall end flaps 140, which connect to respective sidewalls 106 and 108 through fold lines 155 and 157. Fold lines 155 and 157 correspond to fold lines 135 and 137 described below, and allow for sidewall end flaps 140 to conform to edges 159 of voids 151 when assembled as shown in FIG. 1. Base panel 104 includes bottom end flaps 146, and top panels 110 and 114 include top end flaps 148. Gussets 154 connect between adjacent end flaps to facilitate closure of the end flaps.

Figure 4:
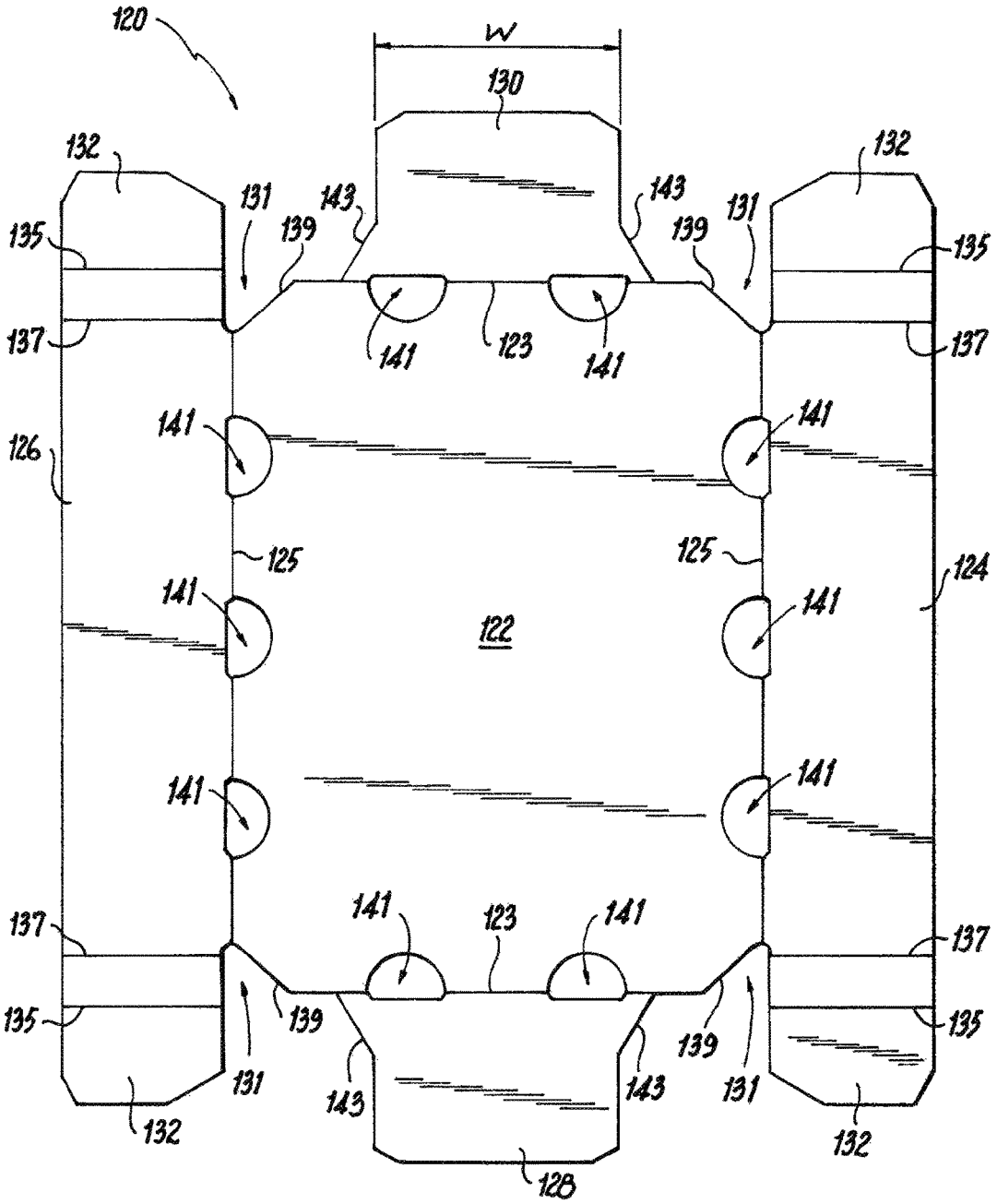
FIG. 4 is a plan view of a blank for the divider of the carton of FIG. 1.
Figure 6:
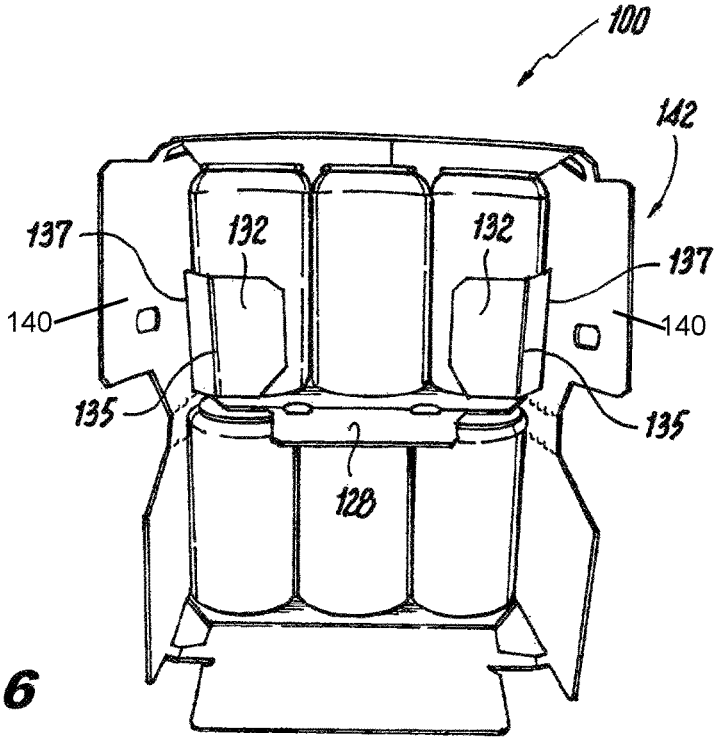
FIG. 6 is a perspective view of the carton of FIG. 1, showing closure of the side end flaps of the divider.
Figure 8:
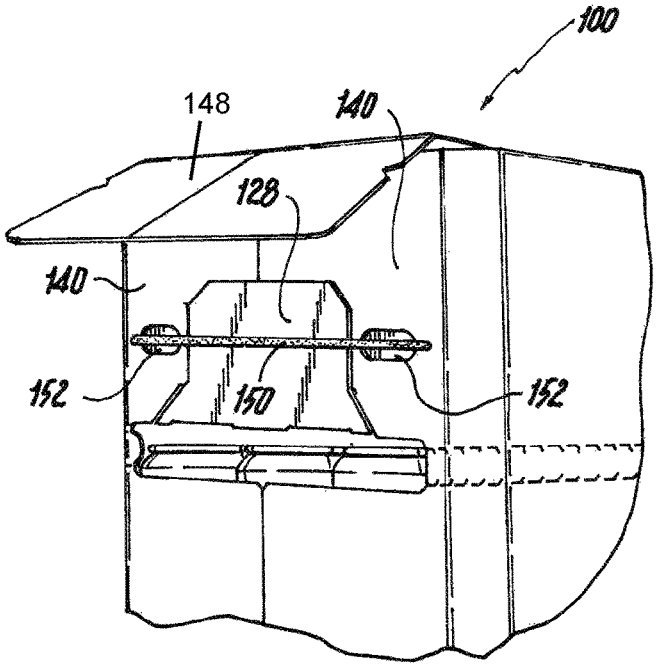
FIG. 8 is a perspective view of the carton of FIG. 1, showing closure of the bottom end flap of the divider.

Referring to FIG. 4, divider blank 120 has a divider panel 122 connected between a pair of opposed flaps 124 and 126 which in this embodiment are designed to be free of adherence to the outer shell 102. However, the flaps 124, 126 may optionally be configured to be adhered to the first and second sidewall panels 106 and 108, respectively. Flaps 124 and 126 are connected to divider panel 122 by respective fold lines 125. There is also a pair of opposed divider bottom end flaps 128 and 130 connected to divider panel 122 by fold lines 123. Flaps 124 and 126 each include an opposed pair of divider side end flaps 132. Each side end flap connects to its respective flap 124 or 126 through a pair of fold lines 135 and 137, which when folded around contents, as shown in FIG. 6, conform to the edge 139 of their respective void 131. The openings 141 along fold lines 123 and 125 provide for machine access to product during packaging. The width W of divider bottom end flaps 128 and 130 is narrower than the distance between openings 152 in the assembled container as shown in FIG. 8 to avoid interfering with adhesion through openings 152. Edges 143 taper the flap width down from a base wide enough to accommodate the openings 141 along fold lines 123.

Figure 5:
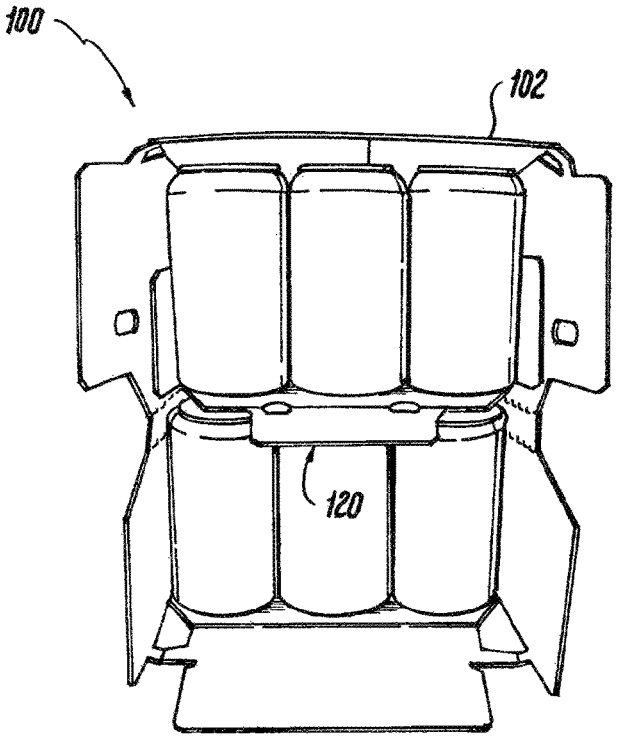
FIG. 5 is a perspective view of the carton of FIG. 1, showing the carton loaded with the end flaps of one end open.
Figure 7:
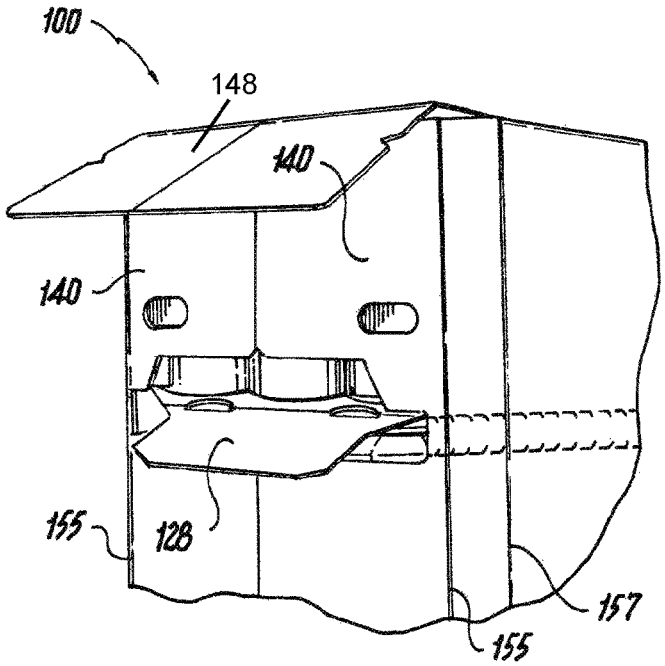
FIG. 7 is a perspective view of the carton of FIG. 1, showing closure of the side end flaps of the outer shell.

The blank shown in FIG. 3 for outer sleeve 102 can be formed into a shell form by folding along fold lines 136 and adhering second top panel 114 to the inside surface of first top panel 110 such that a three-ply handle is provided by the first and second handle portions 112, 116 and a reinforcing handle portion 134. The three-ply handle comprises, reinforcing handle portion 134 adhered to the inside surface of second handle portion 116 that is adhered to the inside surface of first handle portion 112. However, reinforcing handle portion 134 may optionally be disposed between the first and second handle portions 112, 116 to provide the three-ply handle. Divider 120 may or may not be secured inside outer shell 102 by adhering flaps 124 and 126 to the inside surfaces of side panels 108 and 106, respectively, at an elevation above or even below the tear strip portions 118. FIG. 5 shows carton 100 with outer sleeve loaded with contents (e.g., cans) with divider 120 between the contents in the upper tier 142 and those in the lower tier. As shown in FIG. 6, side end flaps 132 of divider 120 can be folded around contents in the upper tier 142 using fold lines 135 and 137. Side end flaps 140 can folded over side end flaps 132, using fold lines 155 and 157 as shown in FIG. 7, and bottom end flap 128 of divider 120 can be folded up over side end flaps 140 as indicated in FIG. 8. A single line 150 of adhesive can be placed along the outside surfaces of side end flaps 140 and bottom end flap 128, and on the outside surfaces of side end flaps 132 exposed through windows 152 in side end flaps 140. Top end flap 148 can then be folded down and adhered along line 150 of adhesive as shown in FIGS. 1 and 2. Bottom end flap can similarly be adhered to side end flaps 140, as shown in FIG. 1.

In the resulting structure, opposed side end flaps 140 of outer shell 102 are disposed between bottom end flap 128 of divider 120 and a pair of opposed side end flaps 132 of divider 120. In FIGS. 1-2 and 5-8, carton 100 is shown with this already having been done on the back side of carton 100. Optionally, bottom end flap 128 of divider 120 can be adhered directly to outside surfaces of the side end flaps 140 of outer shell 102, e.g., with an additional amount of adhesive. Bottom end flap 128 of divider 120 is not adhered directly to side end flaps 132 of divider 120. However, it is also contemplated that the bottom end flap of the divider can be adhered directly to the side end flaps of the divider, as described below with reference to FIGS. 9-16.

Figure 9:
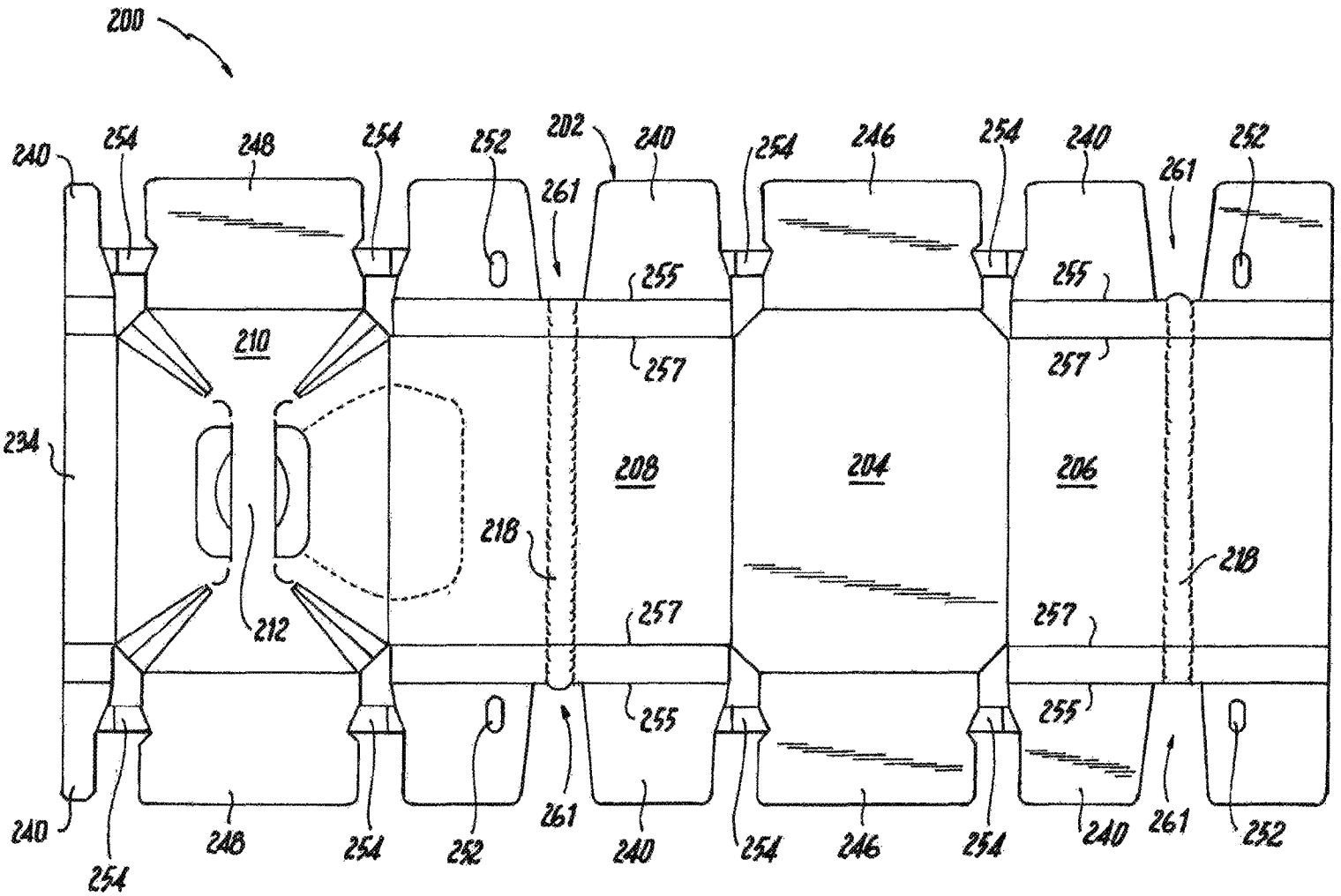
FIG. 9 is a plan view of a portion of another exemplary embodiment of a carton constructed in accordance with this disclosure, showing the blank for the outer shell.

Referring now to FIGS. 9-16, another exemplary embodiment of a carton 200 is shown. A blank 202 for the outer shell for carton 200 is shown in FIG. 9. Outer shell 202 includes bottom panel 204, side panels 206 and 208, end flaps 240 and 246, windows 252, webs 254, and tear strip portions 218 much as described above with respect to carton 100. Outer shell 202 includes a single top panel 210 with opposed top end flaps 248 and an adhering flap 234 which includes its own side end flaps 240 that cooperate with side end flaps 240 of side panel 206. Fold lines 255 and 257 serve the same purpose as fold lines 155 and 157 describe above. Side end flaps 240 are non-webbed, so unlike flaps 140 described above, side end flaps 204 define notches 261 that reach all the way to their respective fold lines 255 to facilitate use with a gusseted divider 220 described below.

Figure 10:
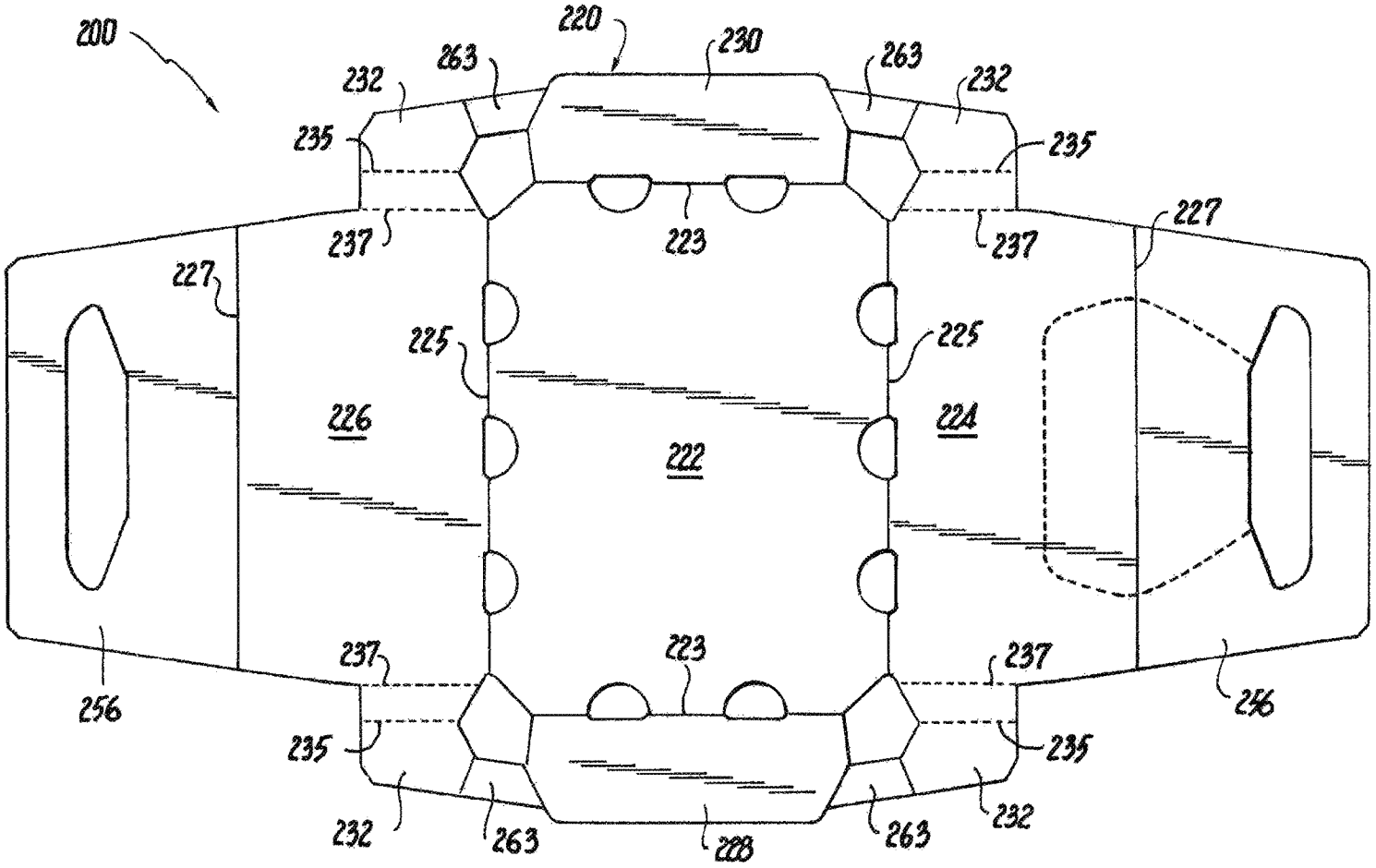
FIG. 10 is a plan view of a portion of the carton of FIG. 9, showing a blank for the divider.

As shown in FIG. 10, divider 220 of carton 200 includes a divider panel 222, flaps 224 and 226, divider bottom end flaps 228 and 230, side end flaps 232, and fold lines 223, 225, 235, 237, much as described above with respect to FIG. 4. Flaps 224 and 226 include handle portions 256 which reinforce handle portion 212 of outer shell 202. Gussets 263 facilitate folding flaps 230, 228 and 232.

Figure 11:
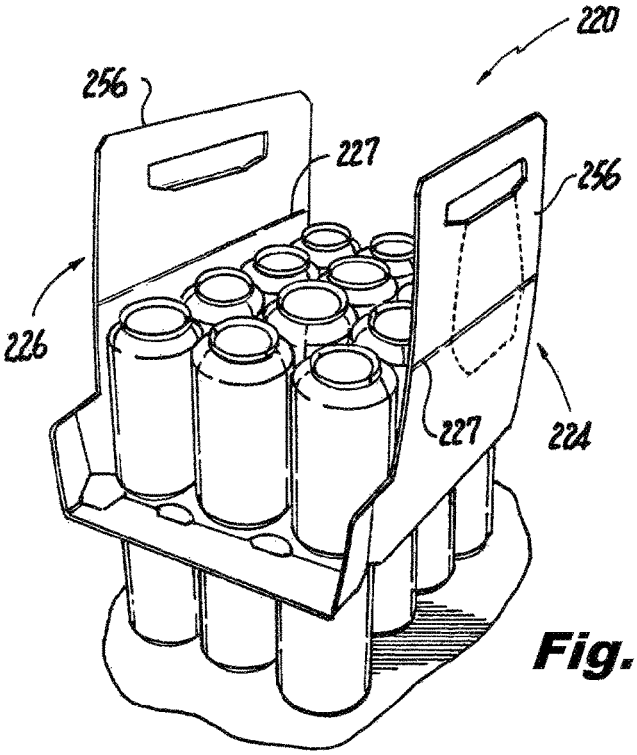
FIG. 11 is perspective view of the carton of FIG. 9, showing loading of the divider.
Figure 12:
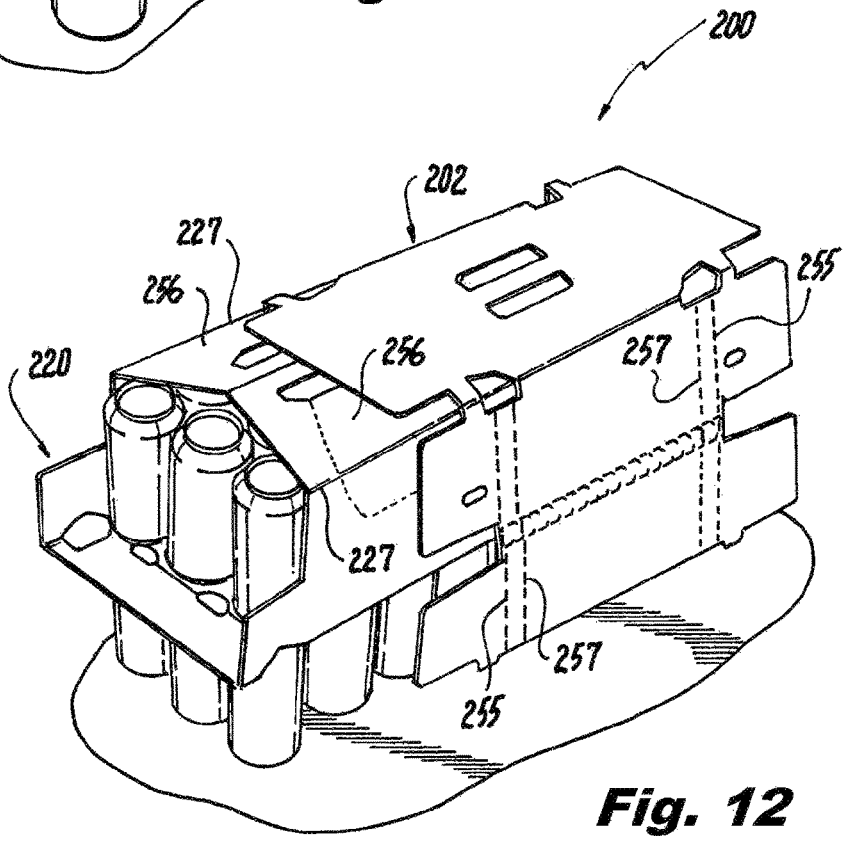
FIG. 12 is a perspective view of the carton of FIG. 9, showing loading of the outer shell.
Figure 13:
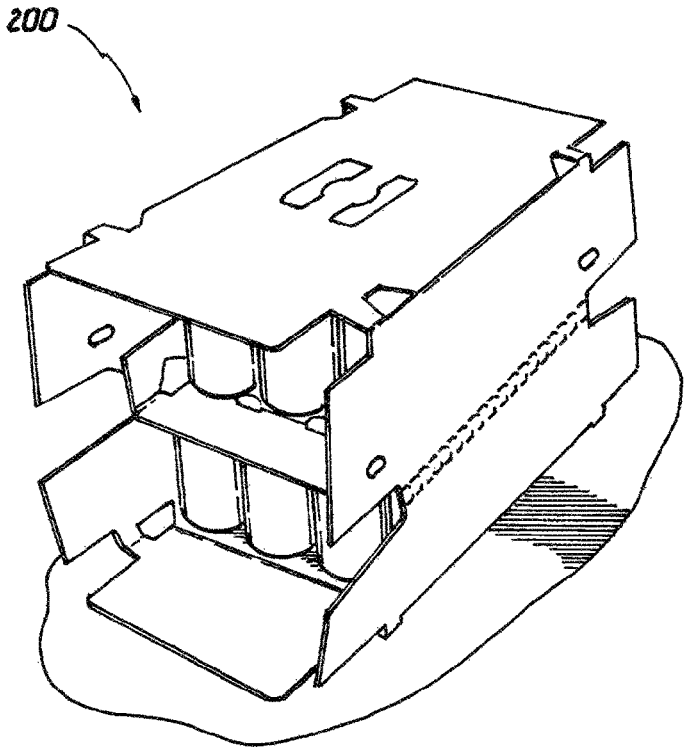
FIG. 13 is a perspective view of the carton of FIG. 9, showing the outer shell loaded prior to closure of the end flaps.
Figure 14:
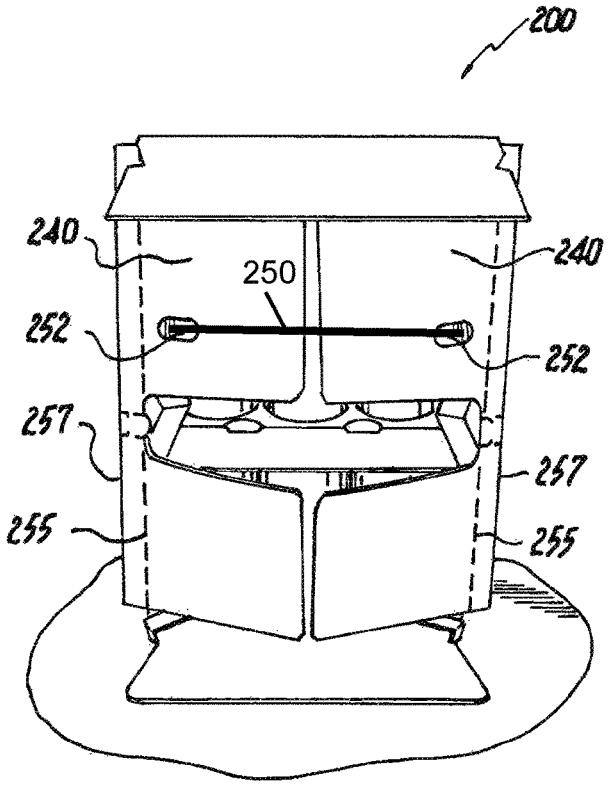
FIG. 14 is a perspective view of the carton of FIG. 9, showing closure of the side end flaps of the outer shell over the side end flaps of the divider.
Figure 15:
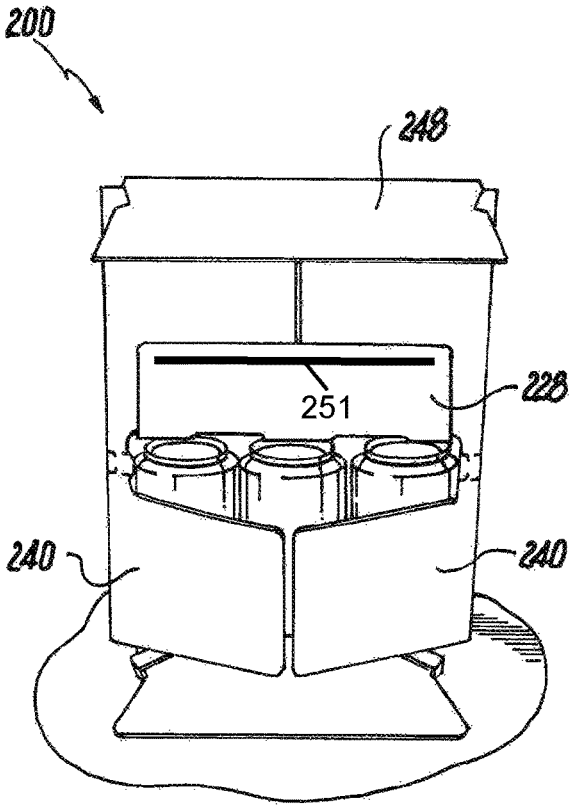
FIG. 15 is a perspective view of the carton of FIG. 9, showing closure of the bottom end flap of the divider.
Figure 16:
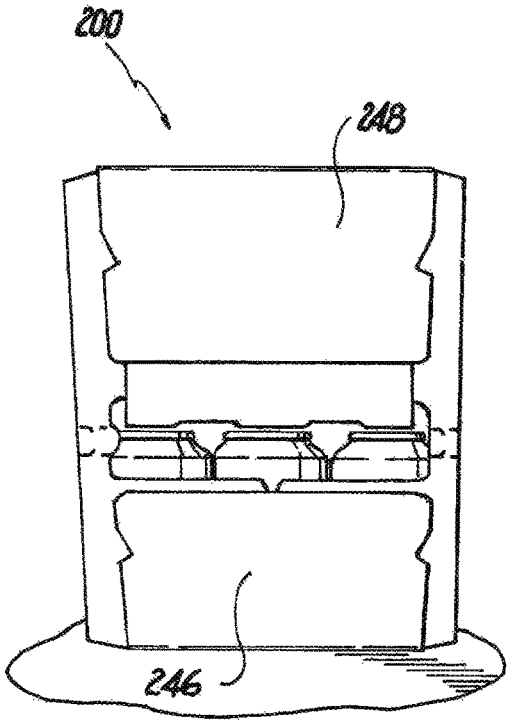
FIG. 16 is a perspective view of the carton of FIG. 9, showing closure of the top end flap of the outer shell.

Referring now to FIG. 11, contents can be loaded into and below divider 220 the flaps 224 and 226 of which can be folded upward. As shown in FIG. 12, outer shell 202 can be formed into a tube similar to outer shell 102 described above, wherein adhering flap 234 is adhered to the inside surface of side panel 206. Handle portions 256 of divider 220 can be folded downward over the contents using fold lines 225 and 227, and the contents and divider 220 can be loaded together into the tube of outer shell 202, as shown in FIG. 13. Closure of the end flaps of each and of carton 200 can be accomplished as follows. Side end flaps 240 and 232 can be folded inward toward the contents as shown in FIG. 14, with side end flaps 240 of the outer shell covering outside of side end flaps 232 of divider 220. A line of adhesive 250 is applied to the outside surfaces of side end flaps 240 such that the line 250 of adhesive extends across each window 252 and between windows 252 (see FIG. 14). Bottom end flap 228 can then be folded upward as shown in FIG. 15, and can be adhered directly to side end flaps 240 as well as side end flaps 232 through windows 252. A line of adhesive 251 is applied to the outside surface of bottom end flap 228 and then top end flap 248 can be folded down and adhered to the outside surface of bottom end flap 228, e.g., by directly adhering it to side end flaps 240 and/or bottom end flap 228 (see FIGS. 15 and 16). Bottom end flap 246 can be adhered directly to side end flaps 240 as shown in FIG. 16.

Figure 17:
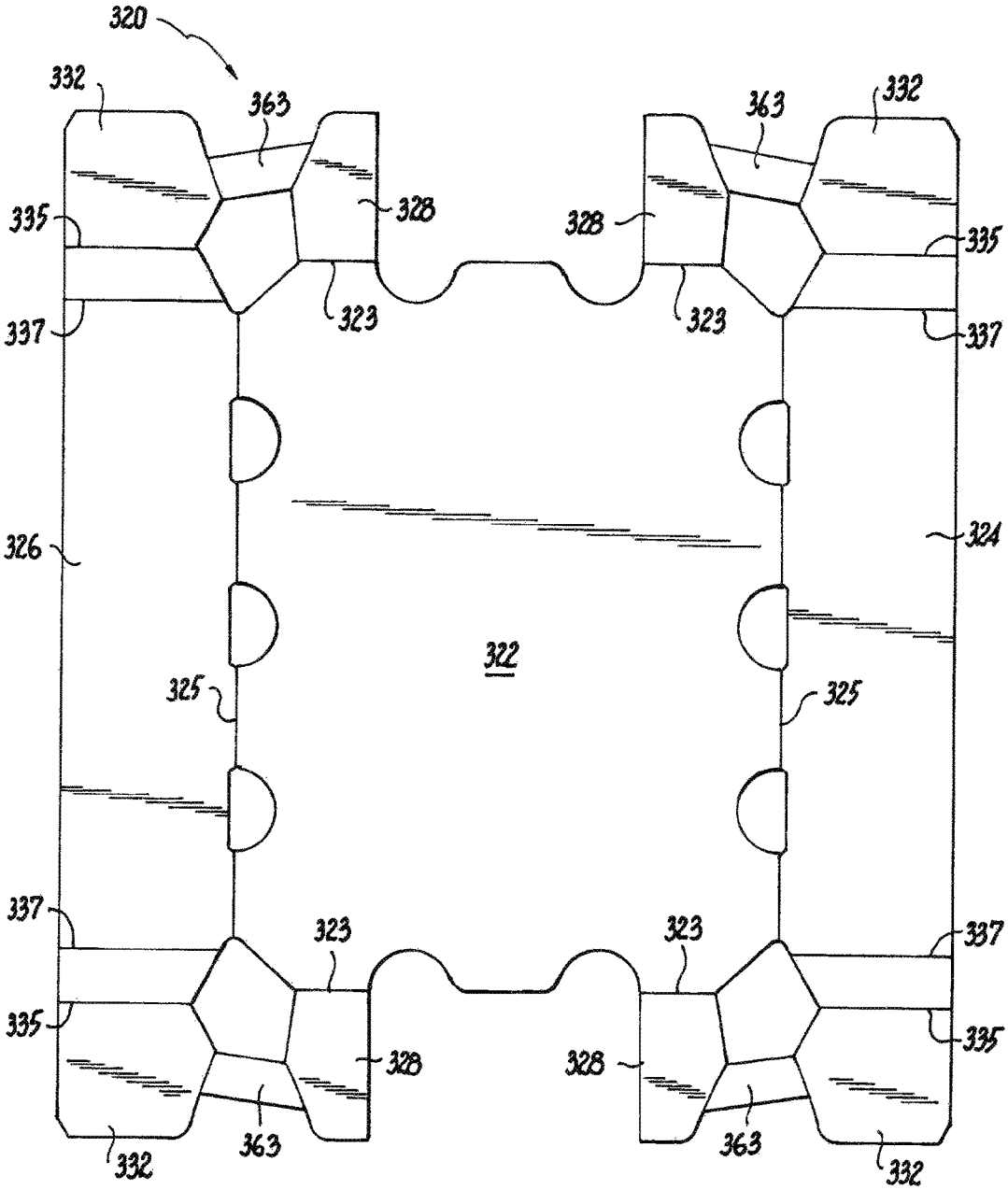
FIG. 17 is a plan view of a portion of another exemplary embodiment of a blank for a divider.

As shown in FIG. 17, another exemplary embodiment of a divider 320 includes a divider panel 322, flaps 324 and 326, side end flaps 332, and fold lines 323, 325, 335, and 337 much as described above with respect to FIG. 4, as well as gussets 363 as described above with respect to FIG. 10. Each divider bottom end flaps 228 and 230 is split into two portions, and as such divider 320 does not by itself form a five-sided structure, i.e., a tray, but can be formed into a portion of a six-sided container with a suitable outer shell as described above.

Figure 18:
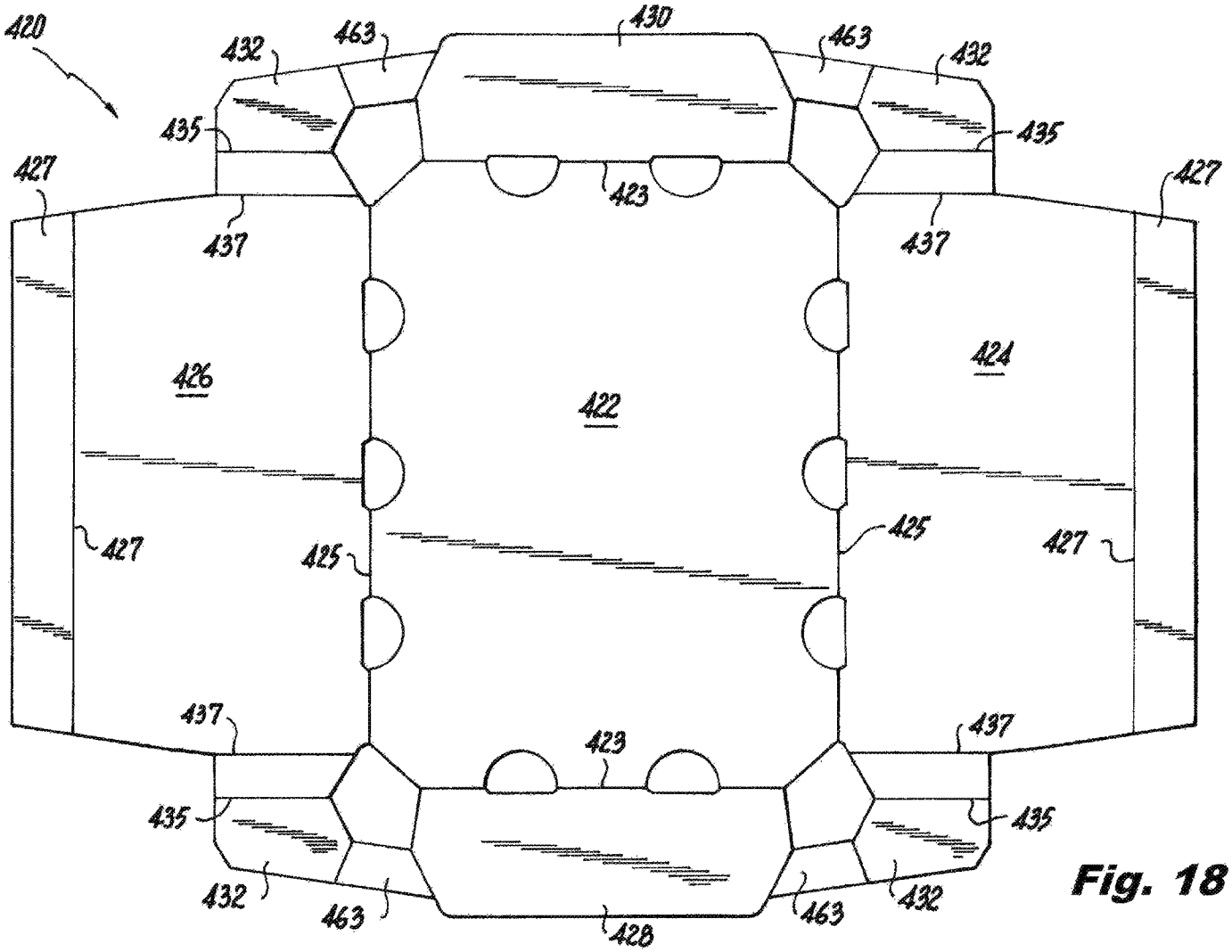
FIG. 18 is a plan view of a portion of another exemplary embodiment of a blank for a divider.

As shown in FIG. 18, another exemplary embodiment of a divider 420 includes a divider panel 422, flaps 424 and 426, side end flaps 432, bottom end flaps 428 and 430, gussets 463, and fold lines much as described above with respect to FIG. 10. Flaps 424 and 426 do not include handle portions, but can be joined to an outer shell along adhesive flaps 427 to reinforce the corner of the outer shell, e.g., along the upper fold lines 136 shown in FIG. 1. This mitigates bowing of the side panels of the outer shell when divider 420 is assembled into an outer shell.

It will be recognized that as used herein, directional references such as "top", "bottom", "base", "front", "back", "end", "side", "upper" and "lower" do not necessarily limit the respective panels to such orientation, but may merely serve to distinguish these panels from one another.

As used herein, the term "fold line" refers to all manner of lines that define hinge features in a substrate of sheet material, for facilitating folding portions of the substrate with respect to one another, or otherwise for indicating optimal folding locations in the substrate. A fold line may be, but not limited to, a single score line, a single half cut, a line of perforations, a line of short slits (i.e., an interrupted slit), a line of half-cuts, a line of cuts (i.e., an interrupted cut line), a series of short score lines (i.e., an interrupted score line), any combination thereof or the like.

As used herein, the term "severance line" refers to all manner of lines formed in a substrate of sheet material that facilitate separating portions of the substrate from one another, or otherwise indicate optimal separation locations on the substrate. For example, a severance line in a substrate of sheet material is predisposed to allow a tear to propagate there-along. A severance line may be a weakened line which includes, but not limited to, a single cut, a single slit, a single half cut, a line of perforations, a line of short slits (i.e., an interrupted slit), a line of half-cuts, a line of cuts (i.e., an interrupted cut line), a series of short score lines (i.e., an interrupted score line), any combination thereof or the like.

The elements of a fold line or severance line (such as cuts, scores and half cuts) may be dimensioned and arranged to provide the desired functionality. For example, a line of perforations can be dimensioned or designed with degrees of weakness to define a fold line and/or a severance line. The line of perforations can be designed to facilitate folding and resist breaking to provide a fold line, to facilitate folding and facilitate breaking with more effort to provide a severable or frangible fold line, or to facilitate breaking with little effort to provide a severance line.

As used herein the term "opening" refers to all manner of shapings, recesses, notches, openings, cuts, cutouts, slots, holes and gaps which may be circular, rectangular, capsule shaped, irregular shaped and many other shapes that are pre-formed or pre-defined.

The methods and systems of the present disclosure, as described above and shown in the drawings, provide for cartons with superior properties including strengthened construction. While the apparatus and methods of the subject disclosure have been shown and described with reference to preferred embodiments, those skilled in the art will readily appreciate that changes and/or modifications may be made thereto without departing from the scope of the subject disclosure.

What is claimed is:

1. A carton comprising:

an outer shell defining an interior space with upper and lower tiers;

a divider disposed at least in part in the outer shell dividing between the upper and lower tiers; and a tear strip defined in the outer shell operatively connecting an upper portion of the outer shell to a lower portion thereof, wherein the upper portion defines a six-sided structure, a bottom side of which includes the divider, the upper portion including a handle wherein the upper portion is configured to be removed from the lower portion by lifting the upper portion by the handle after the tear strip is activated, wherein opposed side end flaps of the outer shell are disposed between a bottom end flap of the divider and a pair of opposed side end flaps of the divider.

2. A carton as recited in claim 1, wherein the bottom end flap of the divider is adhered to outside surfaces of the side end flaps of the outer shell.

3. A carton as recited in claim 2, wherein the bottom end flap of the divider is not adhered directly to the side end flaps of the divider.

4. A carton as recited in claim 2, wherein the bottom end flap of the divider is adhered directly to the side end flaps of the divider.

5. A carton as recited in claim 2, wherein the bottom end flap of the divider is adhered directly to the side end flaps of the divider through a respective window defined through each respective side end flap of the outer shell.

6. A carton as recited in claim 1, wherein the side end flaps of the outer shell, the side end flaps of the divider, the bottom end flap of the divider, and a top end flap of the outer shell are all secured together along a single line of adhesive.

7. A carton as recited in claim 6, wherein the line of adhesive joins the top end flap to the side end flaps of the divider through a respective window defined through each side end flap of the outer shell.

8. A carton as recited in claim 6, wherein the line of adhesive joins an inner surface of the top end flap to an outer surface of the bottom end flap of the divider.

9. A carton as recited in claim 6, wherein the line of adhesive joins an inner surface of the top end flap to an outer surface of each side end flap of the outer shell.

10. A carton as recited in claim 1, wherein the tear strip is disposed below the divider so activation of the tear strip allows removal of the upper portion of the outer shell such that the upper portion can be removed as a separate six-sided container leaving the lower portion with an open top.

11. A carton as recited in claim 1, wherein the divider includes a handle portion operatively connected to the handle of the outer shell for handle reinforcement.

12. A method of forming a carton comprising:

providing an outer shell defining an interior space with upper and lower tiers; and securing a divider to the outer shell to divide between the upper and lower tiers, wherein a tear strip operatively connects between an upper portion and a lower portion of the outer shell, the upper portion including a handle wherein the upper portion is configured to be removed from the lower portion by lifting the upper portion by the handle after the tear strip is activated;

wherein the securing step comprises securing side end flaps of the outer shell between a bottom end flap of the divider and a pair of opposed side end flaps of the divider.

13. A method as recited in claim 12, wherein the step of securing the side end flaps of the outer shell includes adhering so that a top end flap of the outer shell is adhered to the end flaps of the outer shell as well as to an outer surfaces of the bottom end flap of the divider.

14. A method as recited in claim 12, wherein the step of securing the side end flaps of the outer shell includes adhering so that the bottom end flap of the divider is adhered directly to an outside surface of the side end flaps of the outer shell.

15. A method as recited in claim 13, wherein the step of securing the side end flaps of the outer shell includes adhering so that the bottom end flap of the divider is not adhered directly to the side end flaps of the divider.

16. A method as recited in claim 14, wherein the step of securing the side end flaps of the outer shell includes adhering so that the bottom end flap of the divider is adhered directly to the side end flaps of the divider through a respective window defined through each respective side end flap of the outer shell.

17. A method as recited in claim 12, wherein the step of securing the side end flaps of the outer shell includes adhering so that the side end flaps of the outer shell, the side end flaps of the divider, the bottom end flap of the divider, and a top end flap of the outer shell are all secured together along a single line of adhesive.

18. A method as recited in claim 17, wherein the step of securing the side end flaps of the outer shell includes adhering so that the line of adhesive joins the top end flap to the side end flaps of the divider through a respective window defined through each side end flap of the outer shell.

19. A method as recited in claim 17, wherein the step of securing the side end flaps of the outer shell includes adhering so that the line of adhesive joins an inner surface of the top end flap to an outer surface of the bottom end flap of the divider.

20. A method as recited in claim 17, wherein the step of securing the side end flaps of the outer shell includes adhering so that the line of adhesive joins an inner surface of the top end flap to an outer surface of each side end flap of the outer shell.

* * * * *